United States Patent [19]

Soma et al.

[11] 4,365,113

[45] Dec. 21, 1982

[54] SPEAKER UNIT FOR AUTOMOTIVE VEHICLES

[75] Inventors: Hiroshi Soma; Makoto Iyobe; Takekazu Iijima, all of Tokyo; Yutaka Moriyama, Tendo, all of Japan

[73] Assignee: Pioneer Electronic Corporation, Tokyo, Japan

[21] Appl. No.: 186,788

[22] Filed: Sep. 12, 1980

[30] Foreign Application Priority Data

Jan. 7, 1980 [JP] Japan ..... 55-354[U]

[51] Int. Cl.[3] ..... H04R 1/20

[52] U.S. Cl. ..... 179/1 E; 179/1 VE; 179/115.5 PS; 181/144

[58] Field of Search ..... 179/1 E, 1 GA, 1 VE, 179/115.5 PS, 116; 181/144, 145, 146, 147, 199

[56] References Cited

U.S. PATENT DOCUMENTS 4,178,473 12/1979 Vermeren ..... 179/1 VE

FOREIGN PATENT DOCUMENTS 2844212 4/1979 Fed. Rep. of Germany ..... 179/1 E

*Primary Examiner*—George G. Stellar

*Attorney, Agent, or Firm*—Sughrue, Mion, Zinn, Macpeak & Seas

[57] ABSTRACT

A speaker unit for an automotive vehicle including a woofer speaker flush mounted with the rear parcel shelf of the vehicle with a tweeter or medium- and high-range speaker unit mounted to the rear of the woofer speaker. The tweeter speaker is directed toward the passenger compartment of the vehicle. A woofer frame is detachably coupled around the outer edge of the woofer speaker. The woofer frame supports a grill which extends as well over the tweeter speaker. A sound diffuser is positioned over the open surface of the tweeter speaker.

9 Claims, 4 Drawing Figures

SPEAKER UNIT FOR AUTOMOTIVE VEHICLES

BACKGROUND OF THE INVENTION

The invention relates to a speaker unit for automotive vehicles and more particularly to a composite speaker unit for automotive vehicles.

Speaker units for automotive vehicles have been markedly improved so as to provide superior sound reproduction. Recently, a composite speaker unit (coaxial speaker unit) has been used for automotive vehicles. The composite speaker unit is made up of several individual speakers similar to speaker systems intended for home use in which the various speakers are adapted to operate in specific ranges of the sound spectrum. Although the characteristics of such a composite speaker unit are excellent, satisfatory results are not obtainable if the composite speaker unit is used in an automobile. This is due primarily to the fact that the mounting position of the speaker unit is restricted in the vehicle because of inherent structural limitations. The speaker unit is normally mounted flush with and below the rear parcel shelf of the vehicle. The rear parcel shelf is usually slightly sloped such that the rear side portion of the shelf is higher than the front side portion. However, the slope of the rear parcel shelf is not sufficient to direct the central axis of the speaker unit toward the front of the vehicle but instead directs it toward a rear window of the vehicle.

Transmission of low-range sound is not very directional. Therefore, there is little modification of the lower portion of the sound spectrum even if the speaker unit is directed upward. On the other hand, transmission of medium-range or high-range sound is rather strongly directional. The medium-range and the high-range sounds reaching the listeners are reflected from the rear window or ceiling of the vehicle. The direction from which the medium-range and the high-range sounds arrive at the listeners' ears does not coincide with the direction to the actual sound source. This remarkably degrades the stereophonic effect if the speaker units for right and left channels are provided in the rear parcel shelf.

However, the following advantage is obtained if the speaker unit is mounted flush with the rear parcel shelf. Since the space of a trunk can be utilized as a speaker box for the speaker unit, it is advantageous in that the low-range sound is well reproduced. Due to the above noted advantage and for the reason that no space as large in volume as the space of the trunk room is available in the passenger compartment of the vehicle, it is general practice to flush mount the speaker unit on the rear parcel shelf.

SUMMARY OF THE INVENTION

An object of the invention is to provide a speaker unit for vehicles adapted to be flush mounted to the rear parcel shelf of the vehicle in which the medium-range and the high-range sounds are satisfactorily reproduced.

Briefly, in accordance with the invention, a medium- and high-range speaker unit is mounted so that it faces the front of the vehicle while a low-range speaker unit is flush mounted on the rear parcel shelf. The low-range speaker unit includes a woofer speaker having an outer woofer frame. A tweeter support unit is attached to the rear edge of the woofer frame with the tweeter or medium- and high-range speaker rigidly coupled thereto. A woofer grill frame is detachably coupled around the low-range speaker unit. A grill is supported by the woofer grill frame which extends as well over the tweeter speaker. A sound diffuser may be disposed over the open surface of the tweeter speaker.

DESCRIPTION OF THE PREFERRED EMBODIMENTS

A preferred embodiment of the invention will be described with reference to the accompanying drawings.

Figure 1:
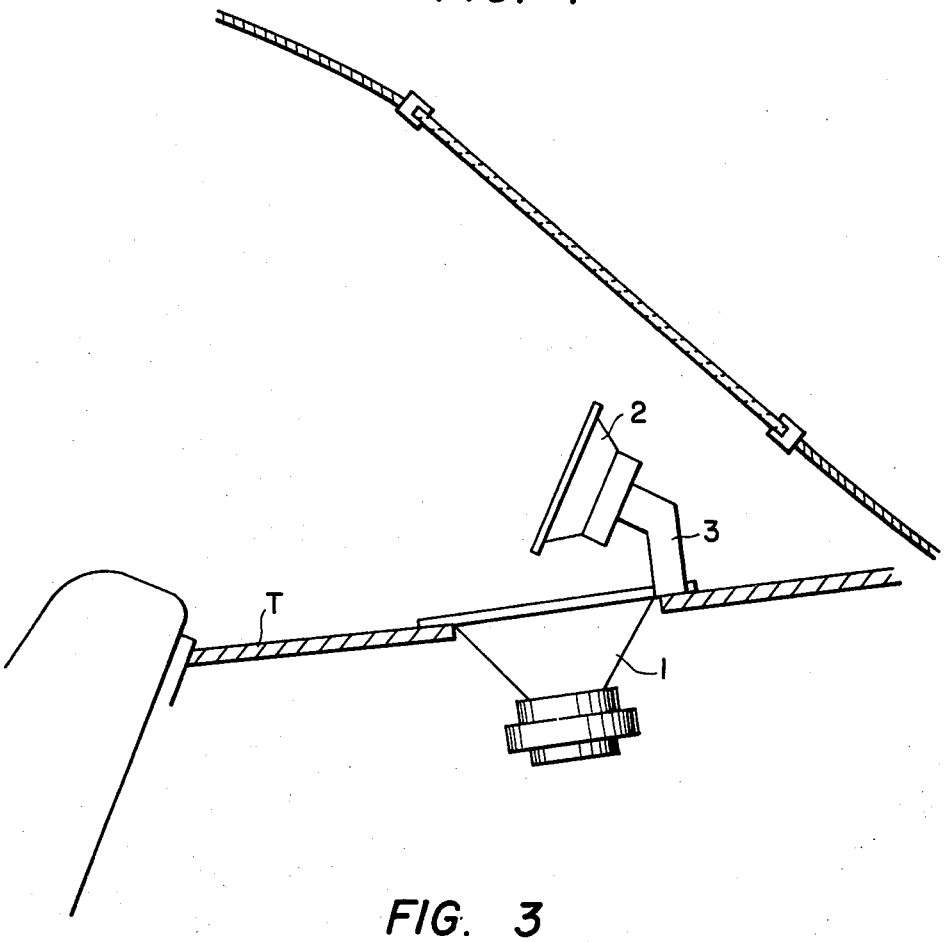
FIG. 1 is a side sectional view showing a speaker unit according to the invention attached to a rear parcel shelf of a vehicle.
Figure 2:
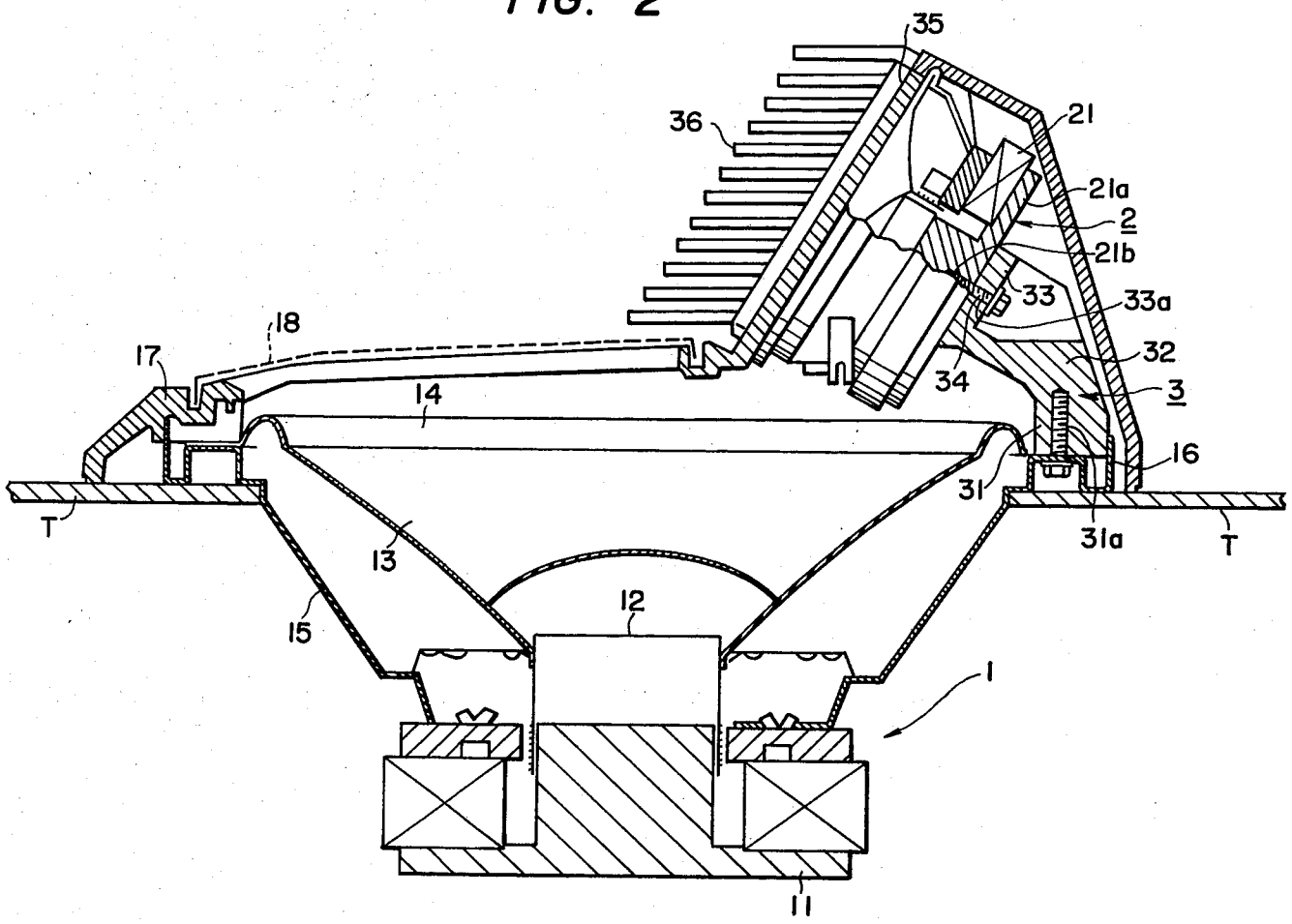
FIG. 2 is a side sectional view showing a speaker unit for automotive vehicles according to the invention.
Figure 4:
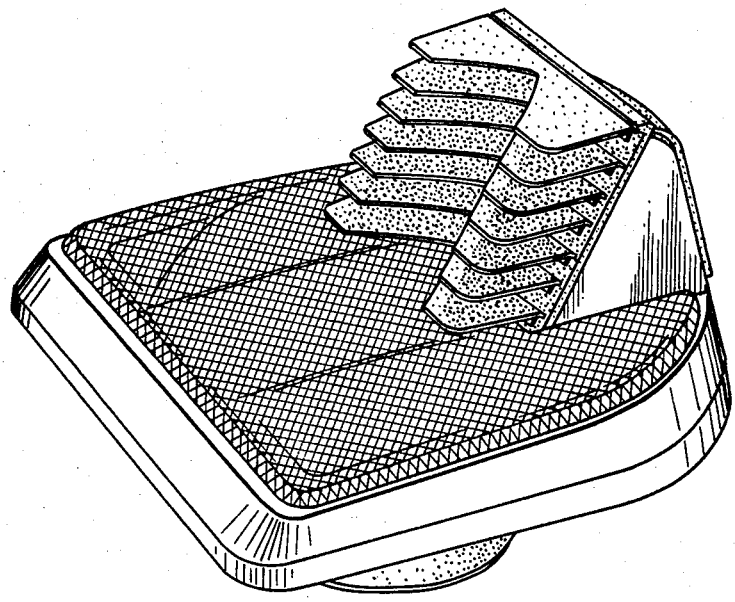
FIG. 4 is a perspective view of the speaker unit of FIG. 2.

Referring to FIGS. 1 and 2, reference numeral 1 designates a woofer unit in which one end of a cone type diaphragm 13 is attached to a voice coil bobbin 12 in a driver unit 11 with the outer peripheral edge 14 of the diaphragm 13 attached to the end of a woofer frame 15 through an interposed gasket 16. FIG. 4 shows a perspective view of the speaker unit of FIG. 2. A holder 3 for holding or supporting a tweeter unit 2 is attached to the woofer frame 15. The lower portion 31 of the holder 3 is rigidly attached to the woofer frame 15. A threaded hole 31*a* which receives a mounting bolt is formed in the center of the lower portion 31. The intermediate portion 32 of the holder 3 is inclined so that its axis intersects the central axis of the woofer unit 2. The upper portion 33 of the holder 3, which holds the tweeter unit 2, has a through hole 33*a* formed therein to allow a fixing bolt 34 to be inserted into a threaded hole formed in the upper portion 33 of the holder 3.

The fixing bolt 34 is engaged with a threaded hole 21*b* formed in a yoke 21*a* which constitutes a driver unit 21 for the tweeter unit 2. A grill 35 is provided over the front surface of the tweeter unit 2. In front of the tweeter unit 2, a diffuser 36 is attached. A woofer grill frame 17 is detachably coupled to the periphery of the front surface of the woofer unit 1. A grill 18 is provided in the grill frame 17. The grill 18, if desired, can be made integral with the grill 35.

Next, an example of a process for fabricating the speaker unit of the invention will be briefly described. Firstly, the holder 3 and the woofer unit 1 are combined together in such a way that a hole formed in the end of the woofer frame 15, a hole in the gasket 16 and the hole 31*a* formed in the lower portion of the holder 3 are aligned to permit a bolt 31 to be screwed into the threaded hole 31*a* through the former two holes. Then, the holder 3 and the tweeter unit 2 are combined and coupled together by screwing the fixing bolt 34 into the hole 33*a* and the hole 21*b* formed in the yole 21*a*.

When the woofer unit 1 is attached to the rear parcel shelf T, it is necessary that the axis of the tweeter 2 be directed to the passenger compartment as shown in FIG. 1. The angle of inclination of the intermediate portion 32 of the holder 3 is determined according to the configuration of the woofer unit 1 and the configuration and the slope of the rear parcel shelf T.

In this embodiment, the slope of the axial line of the tweeter unit 2 forms an angle of approximately 30 degrees with respect to the rear parcel shelf T. The medium- and high-range sound is radiated from the diffuser 36 attached to the front portion of the tweeter unit 2.

Figure 3:
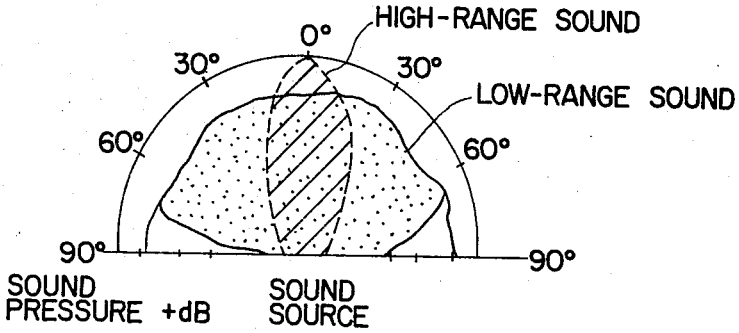
FIG. 3 is a diagram showing the distribution of sound pressure in the passenger compartment of the vehicle.

Shown in FIG. 3 is the distribution of the sound pressure produced by the speaker unit according to the invention. As can be appreciated from this figure, the region to which the high-range sound is delivered is situated in the center of the region to which the low-range sound is delivered and thus the high-range and low-range sounds are reproduced with their sound images coinciding.

As is apparent from the foregoing description, since the woofer unit and the tweeter unit are arranged so that the central axes of the speaker units are not parallel to each other but intersect with each other, the drawbacks accompanying the conventional speaker unit are eliminated with the use of the present invention. Specifically, with the use of the speaker unit of the invention, a good stereophonic effect is obtained because the medium- and high-range sound is directly radiated into the passenger compartment. Further, since the open surfaces of the medium- and high-range and the low-range speakers are covered with an integral grill, the number of the parts used in fabricating the speaker unit is reduced and mass production can be effectively carried out.

What is claimed is:

1. A speaker unit for an automotive vehicle, comprising:

a low-range speaker;

a medium- and high-range speaker;

means for fixedly connecting said low-range speaker and said medium- and high-range speaker so that their central axes intersect in a side section;

grill frame detachably coupled with a peripheral surface of said low-range speaker;

a low-range speaker grill member mounted in said grill frame for covering an open surface of said low-range speaker;

said medium- and high-range speaker being fixedly connected to said low-range speaker by said connecting means so that said medium- and high-range speaker is located in an area outside an area confined by said low-range speaker grill member.

2. The speaker unit of claim 1 further comprising a sound diffuser mounted adjacent said medium- and high-range speaker.

3. The speaker unit of claim 1 wherein said connecting means comprises a medium- and high-range speaker holder, a woofer frame, and a bolt, said holder being connected to said woofer frame by said bolt.

4. The speaker unit of claim 1 wherein a substantial portion of sound reproduced by said low-range speaker is directly radiated into a passenger compartment of said automotive vehicle through said low-range speaker grill member without being substantially reflected and attenuated by said medium- and high-range speaker.

5. A speaker unit for an automotive vehicle, comprising:

a low-range speaker having a woofer frame to which an outer peripheral edge of a diaphragm of said low-range speaker is attached, said woofer frame being adapted to be flushly mounted to a rear parcel shelf of said automotive vehicle;

a tweeter holder rigidly mounted upon a rear edge of said woofer frame, said holder being adapted to support a tweeter unit having a tweeter speaker having a central axis directed towards a passenger compartment of said vehicle, said tweeter speaker being positioned in said tweeter holder;

a woofer grill frame detachably coupled around said low-range speaker; and a low-range grill member supported by said grill frame covering said diaphragm, said holder occupying an area outside an area confined by said low-range grill member.

6. The speaker unit of claim 5 further comprising a sound diffuser positioned over the open surface of said tweeter speaker.

7. The speaker unit of claim 5 wherein a substantial portion of sound reproduced by said low-range speaker is directly radiated into a passenger compartment of said automotive vehicle through said low-range grill member without being substantially reflected and attenuated by said tweeter speaker.

8. The speaker unit of claim 1 or 5 further comprising a medium- and high-range speaker grill member for covering an open surface of said medium- and high-range speaker.

9. The speaker unit of claim 8 wherein said low-range speaker grill member and said medium- and high-range speaker grill member are integrally formed.

* * * * *